US005116140A

United States Patent [19]

Hirashima

[11] Patent Number: 5,116,140

[45] Date of Patent: May 26, 1992

[54] EASY-TO-OPEN SYNTHETIC RESIN BAG

[76] Inventor: Kazuyoshi Hirashima, 511-1, Oaza-Musashi, Chikushino, Fukuoka, Japan

[21] Appl. No.: 644,158

[22] Filed: Jan. 22, 1991

[30] Foreign Application Priority Data

Jun. 15, 1990 [JP] Japan ..... 2-158477

[51] Int. Cl.[5] ..... B65D 27/38

[52] U.S. Cl. ..... 383/206; 383/61; 383/66

[58] Field of Search ..... 383/61, 66; 206/616, 206/617, 618, 619

[56] References Cited

U.S. PATENT DOCUMENTS

| | | | |
|---|---|---|---|
| 3,266,965 | 8/1966 | Spees | 206/616 |
| 3,619,395 | 11/1971 | Skendzic | 383/61 |
| 3,827,472 | 8/1974 | Uramoto | 383/61 |
| 4,629,071 | 12/1986 | Tani | 206/616 |
| 4,650,079 | 3/1987 | Tani | 206/616 |

FOREIGN PATENT DOCUMENTS

| | | | |
|---|---|---|---|
| 308754 | 12/1989 | Japan | 383/61 |

*Primary Examiner*—Stephen P. Garbe

[57] ABSTRACT

An easy-to-open synthetic resin bag comprises (a) a bag body substantially consisting of a pair of laminated walls made of synthetic resin films, the peripheries of the laminated walls being heat-sealed to form a sealed border region while defining an unsealed storing space within the sealed border region, (b) a tear string which is heat sealed along an imaginary opening line on the inside of one of the laminated walls, the tear string having both ends thereof heat sealed in a sandwiched condition on the corresponding portion of the sealed border region, (c) a pulling tab formed by cutting a part of one side portion of the sealed border region which corresponds to one end of the tear string, the pulling tab being tearable from the bag body integrally with the tear string, and (d) a tear string retaining portion comprising a transverse opening which is formed by cutting off a part of the other side portion of the sealed border region and a pair of inside and outside heat sealed portions which are located at both sides of the transverse opening, the transverse opening extending in a direction perpendicular to the tear string such that the tear string passes through a central portion of the transverse opening. Due to such a tear string retaining portion, the separation and complete removal of the tear string from the bag is reliably prevented while assuring the easy bag opening operation.

4 Claims, 5 Drawing Sheets

EASY-TO-OPEN SYNTHETIC RESIN BAG

BACKGROUND OF THE INVENTION

The present invention relates to a synthetic resin bag which can be opened easily by using a tear string and which can keep the tear string on the bag body after the bag is opened.

The Japanese Utility Mode Laid-Open Publication No. 159847/1983 discloses a conventional type of easy-to-open synthetic resin bags which can be opened by using a tear string.

As shown in FIG. 11, this synthetic resin bag substantially comprises; a) a bag body 54 which forms a sealed border region 52 by heat sealing the peripheries of a pair of synthetic resin films 50, 51 and which also forms a sealing space 53 in the interior, and b) a tear string 55 which is heat sealed along the opening position on the one inner side of the bag body 54 and whose both ends are heat sealed on the corresponding portions 52*a*, 52*b* of the sealed border region 52 in a sandwiched condition, and c) a pulling tab 56 which comprises a U-shaped slit 56*a* and a transverse opening 56*b* which is formed with one end of a tear string 55 as a unit so as to be taken off by cutting one side of the corresponding portions 52*a* of the sealed border region 52 of the bag body 54.

Therefore, when the synthetic resin bag is opened, the pulling tab 56 is held by fingers and pulled along an opening line 57 so that the bag can be opened easily by tearing the synthetic resin film 50 by the tear string 55.

However, this synthetic resin bag still has the following problems to be solved.

Namely, since the tear string 55, which opened the synthetic resin bag as shown in FIG. 12, is completely separated from the synthetic resin bag after the part of the bag is cut from the one side end to the other side end, it is cumbersome to dispose of the tear string after the bag tearing operation. Furthermore, it causes an environmental problem when the tear string after cutting is thrown away.

Especially, the use of such a synthetic resin bag in an operating room of a hospital for hermetically accommodating a small item such as a surgical knife requires utmost care. Namely, when the bag is opened to take out the item by pulling the tear string 55, the tear string 55 which is separated from the bag body 54 may be left in a human body by mistake.

Thus, the conventional synthetic resin bag has a problem that the usages or the places of use thereof are restricted because of the complete separation of the tear string from the bag.

Accordingly, it is an object of the present invention to provide a synthetic resin bag which can solve the above drawbacks of the conventional bags.

SUMMARY OF THE INVENTION

The present invention relates to an easy-to-open synthetic resin bag comprising; a) a bag body substantially consisting of a pair of laminated walls made of synthetic resin films, the peripheries of the laminated walls being heat sealed to form a sealed border region while defining an unsealed storing space within the sealed border region, b) a tear string which is heat sealed along an imaginary opening line on the inside of one of said laminated walls, the tear string having both ends thereof heat sealed in a sandwiched condition on the corresponding portion of the sealed border region, c) a pulling tab formed by cutting a part of one side portion of the sealed border region which corresponds to one end of the tear string, the pulling tab being tearable from the bag body integrally with the tear string, and d) a tear string retaining portion comprising a transverse opening which is formed by cutting off a part of the other side portion of the sealed border region the tear string and a pair of inside and outside heat sealed portions which are located at both sides of the transverse opening, the transverse opening extending in a direction perpendicular to the tear string such that the tear string passes through a central portion of the transverse opening.

The easy-to-open synthetic bag of this invention is also characterized by following constructional features. Namely, the central portion of the inside periphery of the outside sealed portion of the tear string retaining portion is protruded toward the outside periphery of the inside portion of the tear string retaining portion. The pulling tab is provided with a color mark which is different from the color of the bag body. A pulling tab indication is provided on the pulling tab.

DETAILED DESCRIPTION OF THE PREFERRED EMBODIMENTS

Figure 1:
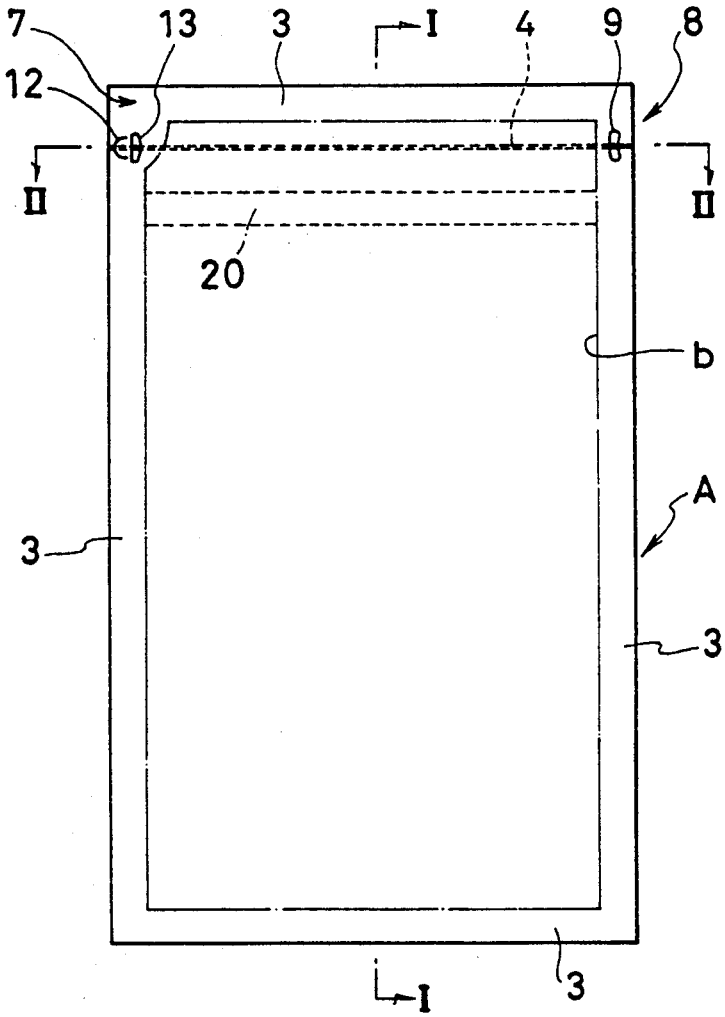
FIG. 1 is a front view of the easy-to-open synthetic resin bag of this invention.

The easy-to-open synthetic resin bag according to the present invention is described in detail hereinafter in conjunction with the embodiments shown in the attached drawings.

In FIG. 1 to FIG. 4, numeral A indicates a rectangular bag body made of synthetic resin. The bag body A is produced by overlapping or superposing a pair of laminated walls 2, 2, each wall 2 being constructed by laminating a desired number of thin synthetic resin films 1, 1*a* and heat sealing the entire peripheries of the overlapped laminated walls 2, 2 to form a rectangular sealed border region 3, thus defining an unsealed interior B in the bag body A.

The sealed border region 3 is provided by heat sealing the overlapped peripheries of the laminated walls 2, 2 by means of a heat roller with a pressure.

Letter b indicates a border line between the sealed border region 3 and the unsealed interior B.

On the bag body A provided with the above construction, a tear string 4 is provided on the upper portion of the inner side of one laminated wall 2. The tear string 4 extends in a transverse direction of the bag body A such that body ends of the tear string 4 terminate at outer edges 3a of the sealed border region 3 of the bag body A.

Figure 4:
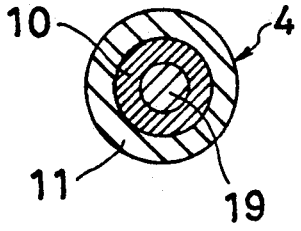
FIG. 4 is a longitudinal cross-sectional view of the tear string.

The inner structure of the tear string 4 is shown in FIG. 4. As shown in this drawings, in this embodiment, the tear string 4 has a triplicate concentric construction which comprises an inner core string 19, an intermediate adhering agent layer 10 and an outer heat sealing or fusing layer 11, wherein the heat fusing layer 11 is fixedly secured to the core string 19 by means of the intermediate adhering agent layer 10.

The core string 19 is preferably made of polyester and preferably has a circular cross section. However, the core string 19 also can have other cross sections such as an elliptical cross section, a polygonal cross section or splines on the outer surface thereof.

The adhering agent layer 10 is formed by coating neoprene on the core string 19. However, the adhering agent layer 10 may be nitrile rubber or a mixture of an epoxy resin and a polyamide.

The heat fusing layer 11 is preferably made of a polypropylene and is concentrically provided on the adhering agent layer 10. However, the heat fusing layer 11 may be made of polypropylene, or copolymer of ethylene and propylene.

The tear string 4 provided with the above-mentioned tripartite construction is fixedly secured to the laminated wall 2 of the bag body A by fusing the entirety of the outer heat fusing layer 11 to the laminated wall 2.

The tear string 4, however, does not have to have a tripartite construction and can have a single construction.

Next, a pulling tab 7 which is disposed at one lateral side of the sealed border region 3 where one end of the tear string 4 terminates is explained in detail referring to FIG. 1 through FIG. 5.

The pulling tab 7 is substantially a part of the sealed border region 3 defined by a U-shaped score 12 spaced apart from the outer edge of the sealed border region 3 of the bag body A and a transverse opening 13 disposed adjacent to the score 12 and close to the inside of the bag body A.

The score 12 is provided at one lateral side of the sealed border region 3 where one end of the tear string 4 is disposed.

The score 12 consists of a round cut 12a which is spaced apart from the outer edge of the lateral side of the sealed border region 3 and a pair of side cuts 12b, 12b symmetrically disposed at both sides of the tear string 4.

Figure 5:
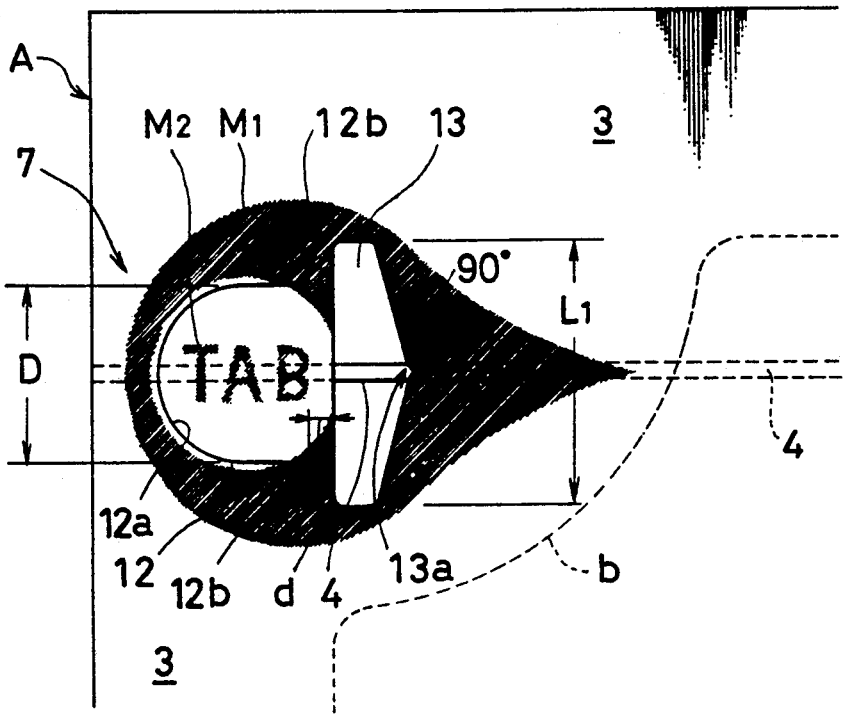
FIG. 5 is an elongated explanatory view of the pulling tab.

The inner ends of the side cuts 12b, 12b are straight or slightly inclined to the tear string 4 as shown in FIG. 5 for assuring the connection of the side cuts 12a , 12b with the opening 13 when the pulling tab 7 is pulled.

The opening 13, as best shown in FIG. 5, extends transverse to an axial direction of the tear string 4 at a position which is located between the inside of the bag body A and the inner ends of the side cuts 12b, 12b of the score 12. The tear string 4 passes through the central portion of the opening 13.

The opening 13 has a length L, transverse to the tear string 4, far greater than the lateral distance D between the inner ends of the side cuts 12b, 12b of the score 12 so that when the pulling tab 7 is pulled upwardly, the inner ends of the side cuts 12b, 12b can accurately reach to the opening 13 without fail.

Furthermore, the opening 13 has an inner central convergent edge 13a closest to the inside of the bag body A and located on the tear string 4. The inner convergent edge 13a makes an angle of less than 90° with the tear string 4 measured from the opening edge toward the interior of the bag body A. Due to such construction, the tearing force can be always guided on the tear string 4.

Figure 3:
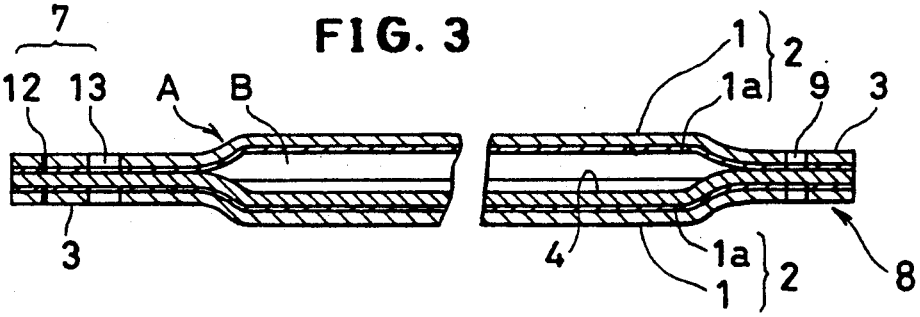
FIG. 3 is a longitudinal cross-sectional view of the bag taken along the line II—II of FIG. 1.
Figure 6:
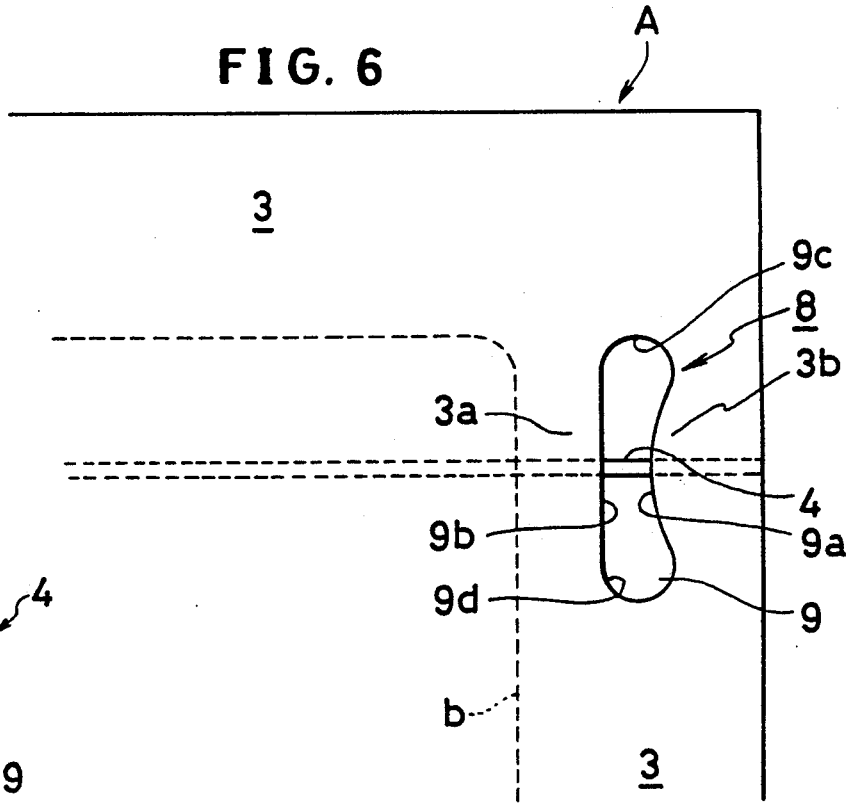
FIG. 6 is an elongated explanatory view of the tear string retaining portion.

Next, the construction of a string retaining portion 8 provided on the sealed border region 3 for retaining the other end of the tear string 4 on the bag body A is explained referring to FIG. 3 and FIG. 6.

Such a string retaining portion 8 substantially comprises a transverse opening 9 which is formed by cutting off part of the sealed border region 3 of the synthetic resin bag body A which corresponds to the other end of the tear string 4, in a direction transverse to the tear string 4 and a pair of inside and outside heat sealed portions 3a, 3b of the sealed border region 3 which are located at both sides of the transverse opening 9.

Especially, in this embodiment, the central portion of the inside periphery 9a of the outside heat sealed portion 3b is protruded in the direction of the outside periphery 9b of the inside heat sealed portion 3a. Therefore, with this construction, the tear string 4 can be prevented effectively from separating and being taken off from the bag body A as described in detail hereinafter.

Furthermore, upper and lower ends 9c, 9d of the transverse opening 9 have a smooth, continuous curve thus avoiding acute or sharp corners or edges to the outside periphery 9a so that the synthetic resin bag is securely prevented from tearing of the bag body A through the ends 9c, 9d.

Figure 9:
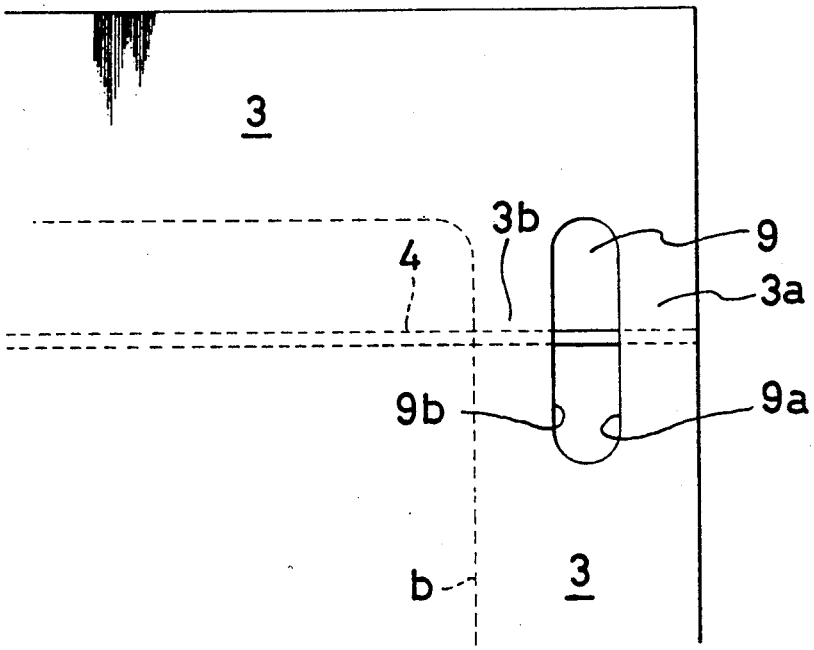
FIG. 9 and FIG. 10 are explanatory views showing variations of the tear string retaining portion.
Figure 10:
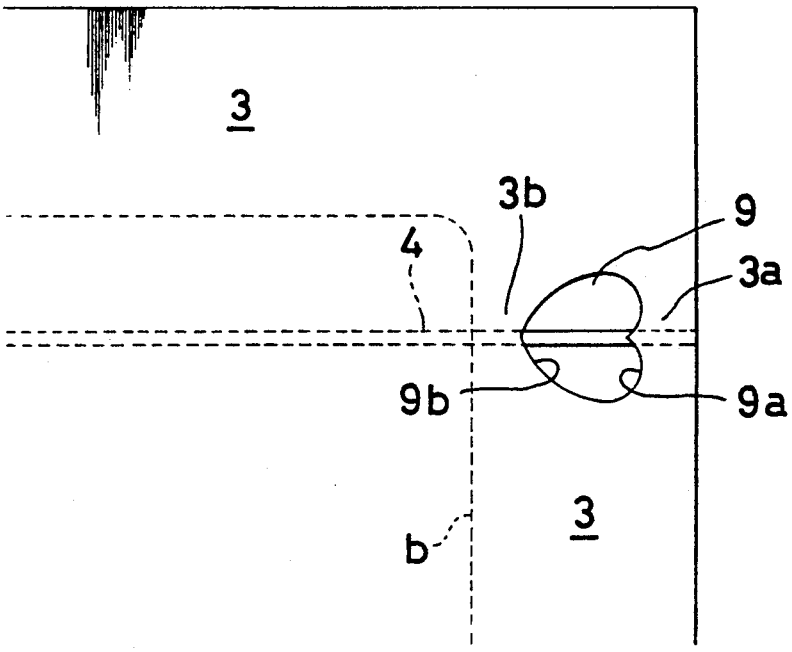
Figure 11:
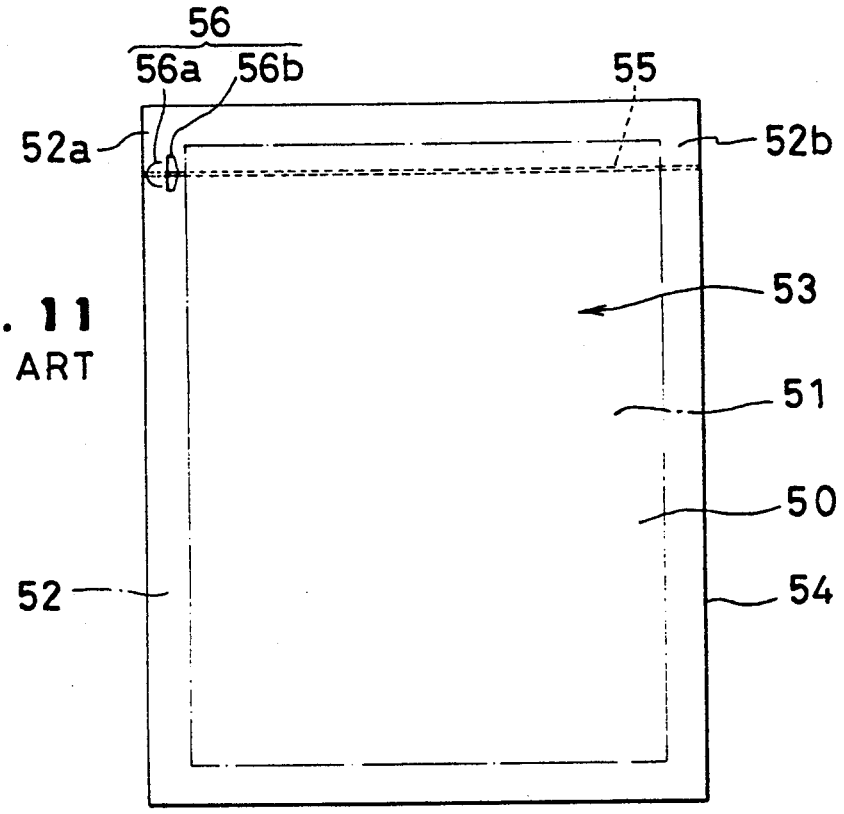
FIG. 11 PRIOR ART
FIG. 11 is a plan view of a conventional synthetic resin bag.
Figure 12:
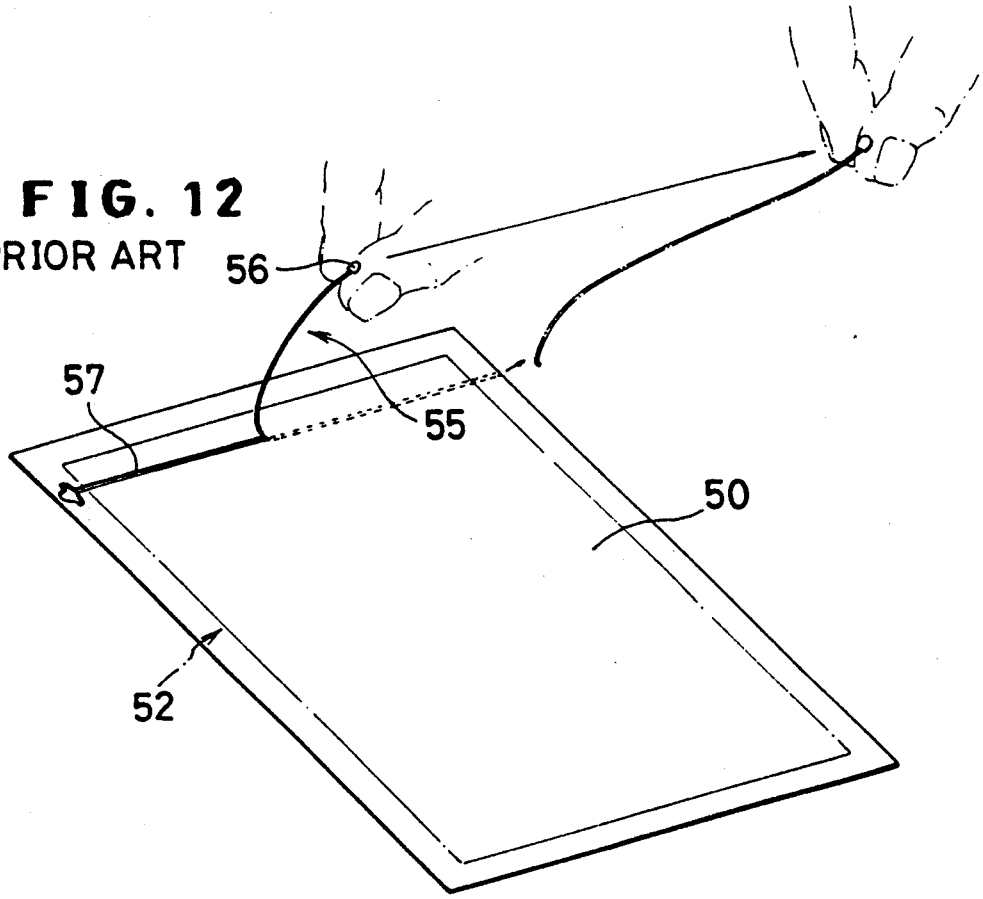
FIG. 12 PRIOR ART
FIG. 12 is an explanatory view of the manner of opening the bag of FIG. 11.

A variation of the above tear string retaining portion 8 is shown in FIG. 9 and FIG. 10.

In FIG. 9, the transverse opening 9 is formed by a pair of straight parallel side peripheries 9a, 9b and a pair of round curved ends 9c, 9d.

In FIG. 10, the transverse opening 9 is formed in a heart shape protruding the central portion of the inside periphery of the outside heat sealed portion 3b towards the outside periphery 9b of the inside heat sealed portion 3a.

Figure 7:
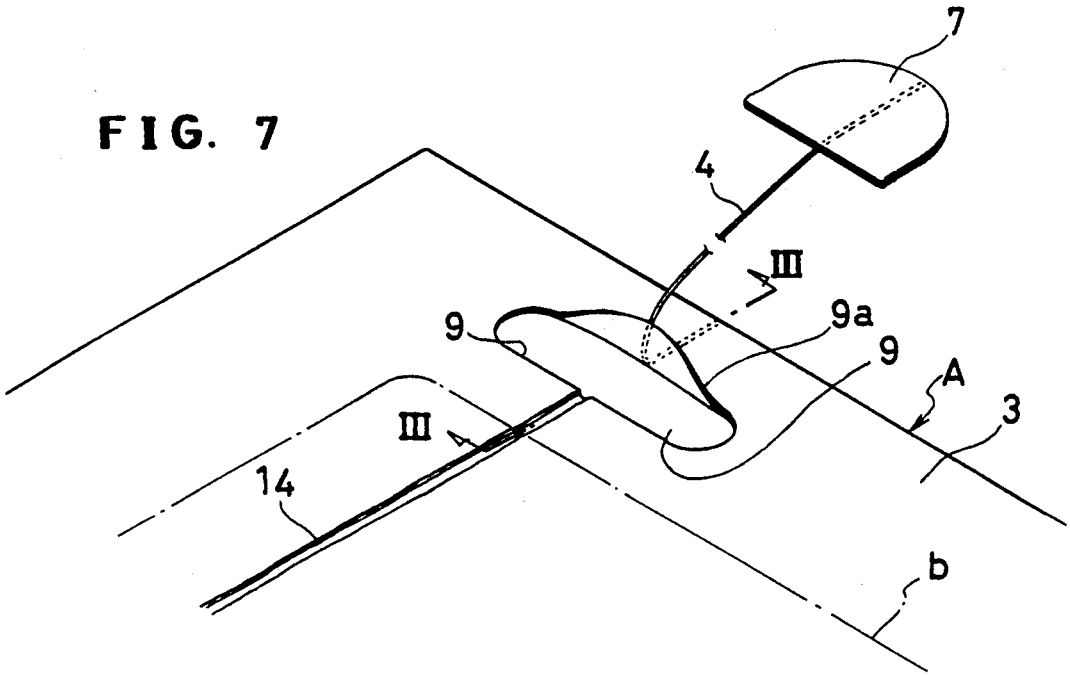
FIG. 7 is an explanatory view of the opening procedure.

In both variations, when the pulling force is applied to the outside heat sealed portion 3a, the outside heat sealed portion 3a is turned up as shown in FIG. 7. Accordingly, the pulling force applied to the outside heat sealed portion 3a can be divided into a number of small component forces which are dispersed in many radial directions from the outside heat sealed portion 3a. Since the small component forces are far below a force necessary to tear off the outside sealed portion 3a, the tear string 4 can be kept on the bag body A.

The manner in which the bag of this invention is opened is hereinafter disclosed in view of FIGS. 1, 6, 7 and 8.

To open the bag body A, the pulling tab 7 is firstly separated from the sealed border region 3. Such separation can be easily effected with the tab construction of this invention.

Namely, as shown in FIG. 5 and FIG. 6, when the portion of the sealed border region 3 around the socre 12 is folded downwardly relative to the sealed border region 3 defined within the score 12, the pulling tab 7 made of such a sealed border region defined within the score 12 protrudes outwardly from the bag body A and is easily pinched by fingers.

Then, the pulling tab 7 is pulled in a direction toward the other end of the tear string 4 as shown in FIG. 7. The tear string 4 first tears the portion d between the score 12 and the opening 13, and, then, guided by the convergent edge 13*a*, the tear string 4 tears the bag body A along the imaginary opening line to provide the opening 14 as shown in FIG. 7.

Since the removal of the outer heat fusing layer 11 from the core string 19 is completely prevented by the presence of the adhering agent layer 10, the opening of the bag body A is effected without fail.

Additionally, in this invention, as described previously, the string retaining portion 8 substantially comprises a transverse opening 9 which is formed by cutting off a part of the sealed border region 3 of the synthetic resin bag body A which corresponds to the other end of the tear string 4, in a direction transverse to the tear string 4 and a pair of inside and outside heat sealed portions 3*a*, 3*b* of the sealed border region 3 which are located at both sides of the transverse opening 9.

Figure 8:
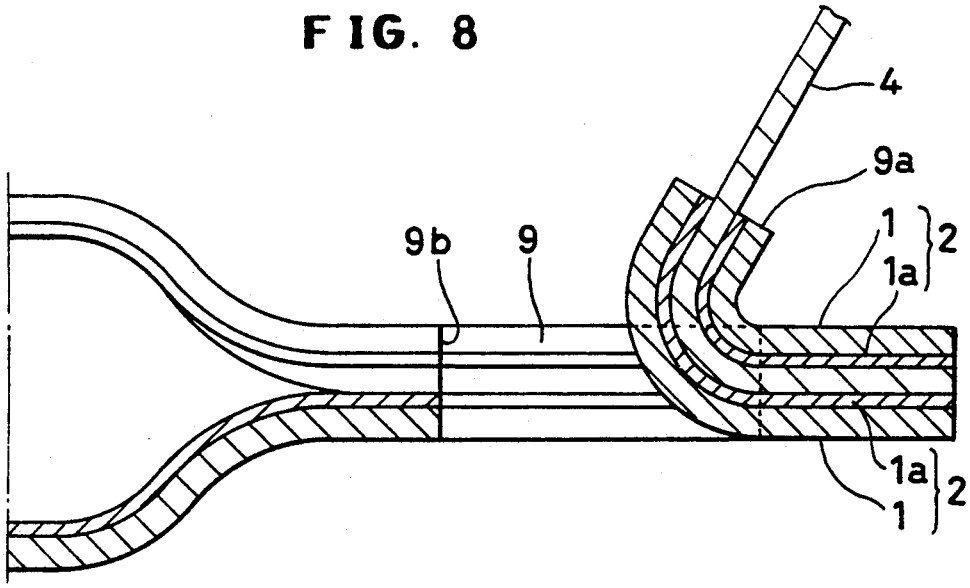
FIG. 8 is a cross-sectional view of the bag taken along the line III—III of FIG. 7.

Therefore, as described previously, when the bag body A is torn from one side to the other side, the tear string 4 reaches the transverse opening 9 first. Then, when the pulling tab 7 is further pulled in the tearing direction with the tear string 4, the portion heat sealed 3*a* of the sealed border region 3 sealing the tear string 4 in a sandwiched manner is turned upwardly as shown in FIG. 7 and FIG. 8, and the pulling force is dispersed or scattered in radial directions as a number of small component forces on the sealed border region 3 so that the concentration of the pulling force in a direction along the tear string 4 can be avoided. Therefore, the tear string 4 can be securely prevented from separating and removal from the synthetic resin bag A. Furthermore, since the central portion of the inside periphery 9*a* of the opening 9 is protruded in the direction of the inside periphery 9*b* of outside heat sealed portion 3*b* is protruded in the direction of the outside periphery 9*b* of the inside heat sealed portion 3*a*, the pulling force can be dispersed or scattered more effectively so that the tear string 4 can be more effectively prevented from separation and removal from the synthetic resin bag. Therefore, disposal of the torn-out tear string 4 and the consequent environmental pollution are no longer concerns.

In addition, in case the synthetic resin bag is used in an operating room of a hospital and so on, when the synthetic resin bag is opened, the tear string 4 can be securely prevented from separating and being removed from the bag body A so that the tear string 4 can be completely prevented from coming into a human body by mistake. Therefore, in the various and extensive fields where a sealed synthetic resin bag having a quick and easy opening is needed, the synthetic resin bag can be used effectively.

The other constructions in this embodiment are explained as follows.

As shown in FIG. 5, a color mark $M_1$ which has a different color from the color of the bag body A, is provided around the pulling tab 7 having the pulling tab indication $M_2$ inside.

The color mark $M_1$ may be any color provided that the color makes a clear contrast relative to the color of the bag body A.

Due to the provision of such color mark $M_1$ and the pulling tab indication $M_2$, the position of the pulling tab 7 is readily recognized and the pulling direction of the pulling tab 7 or the tearing direction by the tear string 4 is also readily understood so that the tearing operation can be readily and smoothly effected.

Figure 2:
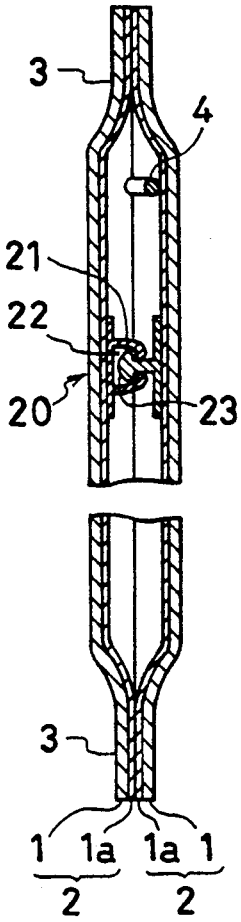
FIG. 2 is a longitudinal cross-sectional view of the bag taken along the line I—I of FIG. 1.

In addition, as shown in FIG. 1 and FIG. 2, a sealing fastener 20 extending in parallel with the tear string 4 is provided beneath the tear string 4 on the bag body A.

As shown in FIG. 2, such sealing fastener 20 is defined by fusing a U-shaped cross sectional, elongated female member 21 on the inner surface of the one laminated wall 2 and by providing an elongated catch protrusion 23, which engages removably with the catch groove 22 of the female member 21, on the inner surface of the other side of the laminated wall 2.

With the above construction, after the bag body A is torn by the tear string 4 and the sealing between the catch groove 22 and the catch protrusion 23 is released to take out a part of the contents, by sealing the catch groove 22 and the catch protrusion 23 again, the contents can be kept from moisture so that the freshness of the contents can be kept as long as possible.

I claim:

1. An easy-to-open synthetic resin bag comprising:

a) a bag body substantially consisting of a pair of laminated walls made of synthetic resin films, the peripheries of said laminated walls being heat sealed to form an annular sealed border region while defining an unsealed storing space within said sealed border region, b) a tear string which is heat sealed along an imaginary opening line on the inside of one of said laminated walls, said tear string having both ends thereof heat sealed in a sandwiched condition on corresponding side portions of said sealed border region, c) a pulling tab formed by cutting a part of one of said side portions of said sealed border region which corresponds to one end of said tear string, said pulling tab being tearable from said bag body integrally with said tear string, and d) a tear string retaining portion comprising a transverse opening which is formed by cutting off a part of the other of said side portions of said sealed border region and a pair of inside and outside heat sealed portions which are located at both sides of said transverse opening, said transverse opening extending in a direction perpendicular to said tear string such that said tear string passes through a central portion of said transverse opening.

2. An easy-to-open synthetic resin bag according to claim 1, wherein said outside heat sealed portion has an inside periphery, said inside heat sealed portion has an outside periphery, and a central portion of the inside periphery of said outside heat sealed portion is protruded toward the outside periphery of said inside heat sealed portion.

3. An easy-to-open synthetic resin bag according to claim 1, wherein said pulling tab is provided with a color mark which is different from said bag body in color.

4. An easy-to-open synthetic resin bag according to claim 1, wherein a pulling tab indication is provided on said pulling tab.

* * * * *